US007422112B1

(12) United States Patent
Harte

(10) Patent No.: US 7,422,112 B1
(45) Date of Patent: Sep. 9, 2008

(54) PROTECTIVE CONTAINMENT OF VALUED ARTICLES

(75) Inventor: Glenn W. Harte, Mesquite, NV (US)

(73) Assignee: Museum Quality Shipping, LLC, Mesquite, NV (US)

( * ) Notice: Subject to any disclaimer, the term of this patent is extended or adjusted under 35 U.S.C. 154(b) by 524 days.

(21) Appl. No.: 11/203,760

(22) Filed: Aug. 15, 2005

(51) Int. Cl.
*B65D 85/30* (2006.01)
*B65D 81/02* (2006.01)

(52) U.S. Cl. ..... 206/583; 206/586; 206/453

(58) Field of Classification Search ..... 206/583, 206/521, 586, 453, 454, 584, 523, 325, 724, 206/448, 449
See application file for complete search history.

(56) References Cited

U.S. PATENT DOCUMENTS 1,890,467 A * 12/1932 McCarroll ..... 206/451
2,895,599 A * 7/1959 Moyer et al. ..... 206/454
3,655,034 A 4/1972 Stollman et al.
4,162,729 A 7/1979 Kaiser et al.
4,583,639 A 4/1986 Fedick et al.
4,664,254 A 5/1987 Sitwell et al.
4,892,193 A 1/1990 Thomas
5,259,523 A 11/1993 Scherb
5,518,118 A * 5/1996 Putz et al. ..... 206/449
5,595,301 A 1/1997 Putz et al.

* cited by examiner

*Primary Examiner*—J. Gregory Pickett
(74) *Attorney, Agent, or Firm*—Arthur Jacob

(57) ABSTRACT

A valued article, such as artwork, an antiquity or a collectible, is contained within a container protected against impact and shock during transportation and storage by connecting the article to an inner frame at spaced apart connections along the perimeter of the article and suspending the inner frame from a surrounding outer frame at spaced apart suspenders along the perimeter of the inner frame, the suspenders being constructed of a shock-absorbing material to isolate the inner frame from the transmission of shocks from the outer frame to the inner frame and the spaced apart arrangement of connections and suspenders establishing open gaps which deter the transmission of impacts from outside the container to the article. Additional open gaps between covers affixed to the outer frame and the contained article further deter the transmission of impacts from outside the container to the article.

18 Claims, 3 Drawing Sheets

PROTECTIVE CONTAINMENT OF VALUED ARTICLES

The present invention relates generally to the protective containment of valued articles, such as artwork, antiquities and valuable collectibles, against damage during transportation and storage and pertains, more specifically, to containers and methods of containment which enable the attainment of a greater level of protection for such items with increased ease of construction and economy of materials.

An ever-increasing mobility being experienced by people and organizations in present-day society has given rise to a need for the safe transport and storage of valued articles, such as artwork, antiquities and collectibles. These items frequently are moved over considerable distances from one location to another and require packing systems which will protect against damage to the article being transported or stored in connection with such movement. While numerous packing systems currently are available for the protective containment of articles to be transported or stored, these systems usually are highly elaborate, requiring relatively expensive construction accomplished by skilled workers utilizing sophisticated materials, methods and apparatus.

The present invention enables economical packing of valued articles for transportation and storage with a high degree of protection against damage. As such, the present invention attains several objects and advantages, some of which are summarized as follows: Attains a high level of protection against damage during transportation and storage of a valued article with a relatively economical construction and method; provides a construction and method for isolation of a packed article from deleterious shocks and impacts during transportation and storage of the article, and does so with increased ease, economy and simplicity; enables the accomplishment of effective protective packing of valued articles for transport and storage utilizing readily available materials and requiring only moderate skills, and capable of being completed without the necessity for specialized facilities; maximizes effective protective packing tailored specifically to the particular dimensions and configuration of a valued article, such as artwork, an antiquity or a collectible, with minimal expense, in terms of requirements in materials, labor and facilities; attains consistently reliable results in the protective packing of valued articles with minimal expenditure of time and materials; enables increased ease of unpacking valued articles protected against damage during transport and storage, with minimal risk of damage to the article during unpacking, and with reduced waste of packing materials; provides exemplary performance with increased economy in the effective containment of valued articles over a wide range of shapes and sizes protected against damage during transport and storage.

The above objects and advantages, as well as further objects and advantages, are attained by the present invention which may be described briefly as a container for containing a valued article protected against impact and shock during transportation and storage, the article having a front face, a back face, and a perimeter bordering the front face and the back face of the article and extending perimetrically around the article, the container comprising: an inner frame dimensioned and configured for extending around the perimeter of the article; connections for connecting the inner frame to the article at spaced apart locations along the perimeter of the article; an outer frame for extending perimetrically around the inner frame, the outer frame being dimensioned and configured for being spaced outwardly away from the inner frame upon placement of the outer frame perimetrically around the inner frame; suspenders for suspending the inner frame from the outer frame at perimetrically spaced apart locations, the suspenders being dimensioned and configured for spacing the outer frame from the inner frame to establish first open gaps along perimetric distances between adjacent suspenders upon suspending the inner frame from the outer frame; the suspenders being constructed of a shock-absorbent material for deterring the transmission of shocks from the outer frame to the inner frame; and front and back cover members for securement to the outer frame, the front and back covers being dimensioned and configured to extend over the front face and the back face, respectively, of the article; the outer frame being further dimensioned and configured for spacing the front and back cover members respectively forward and back from the article and from the inner frame to establish second open gaps between the article and the front and back covers and between the inner frame and the front and back covers upon securement of the front and back covers to the outer frame; the first and second open gaps deterring the transmission of impacts from outside the container to the article.

In addition, the present invention provides a method for protecting an article against impact and shock during transportation and storage, the article having a front face, a back face, and a perimeter bordering the front face and the back face of the article and extending perimetrically around the article, the method comprising: extending an inner frame around the perimeter of the article; connecting the inner frame to the article at connections placed only at spaced apart locations along the perimeter of the article; extending an outer frame perimetrically around the inner frame, and dimensioning and configuring the outer frame so as to space the outer frame outwardly away from the inner frame upon placement of the outer frame perimetrically around the inner frame; suspending the inner frame from the outer frame at suspenders placed at perimetrically spaced apart locations, and dimensioning and configuring the suspenders so as to space the outer frame from the inner frame and establish first open gaps along perimetric distances between adjacent suspenders upon suspending the inner frame from the outer frame; constructing the suspenders of a shock-absorbent material so as to deter the transmission of shocks from the outer frame to the inner frame; securing front and back cover members to the outer frame, and dimensioning and configuring the front and back covers so as to extend the front and back covers over the front face and the back face, respectively, of the article; and further dimensioning and configuring the outer frame so as to space the front and back cover members respectively forward and back from the article and from the inner frame and establish second open gaps between the article and the front and back covers and between the inner frame and the front and back covers upon securement of the front and back covers to the outer frame; whereby the first and second open gaps deter the transmission of impacts from outside the container to the article.

The invention will be understood more fully, while still further objects and advantages will become apparent, in the following detailed description of preferred embodiments of the invention illustrated in the accompanying drawing, in which.

Figure 1:
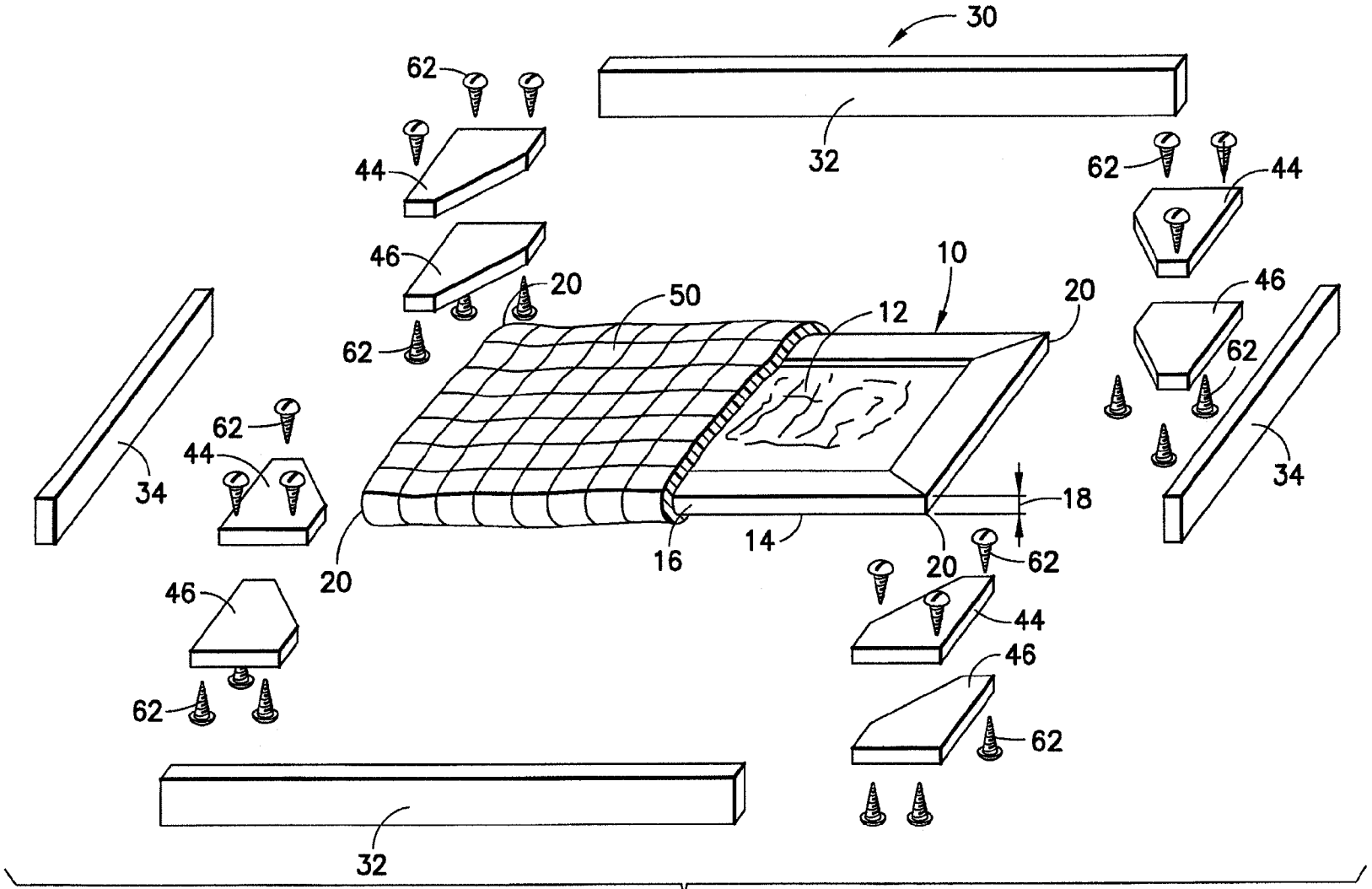
FIG. 1 is an exploded pictorial view showing a portion of a container and method of the present invention.

Referring now to the drawing, and especially to FIG. 1 thereof, a valued article in the form of a piece of artwork is illustrated as a framed painting 10 which is to be packaged for transport, with the framed painting 10 protected against damage during transport, as well as during any storage connected with such transport. Framed painting 10 includes a front face 12, a back face 14 and a perimeter 16 bordering the front face 12 and the back face 14, the perimeter 16 extending longitudinally and laterally perimetrically around the framed painting 10, and a maximum thickness 18 which, in the illustrated artwork, is located along the perimeter 16 and extends in an altitudinal direction. The framed painting 10 is rectangular in plan an includes four corners 20.

A container constructed in accordance with the present invention includes an inner frame 30 having longitudinal frame members 32 and lateral frame members 34. The frame members 32 and 34 are constructed of a relatively inexpensive and rigid material, such as a crate wood or a composition board, and are arranged to extend around the perimeter 16 of the framed painting 10. Upon assembly of the inner frame 30, a rigid corner connection 40 is established at each corner 20 (see FIG. 2), each corner connection 40 including a front gusset 44 and a back gusset 46. The corner connections 40 are dimensioned and configured such that upon affixing the gussets 44 and 46 to the frame members 32 and 34, each corner 20 of the framed painting 10 is received within a complementary recess, illustrated as a triangular recess 48, at each respective corner 20. The fit between each corner 20 and a corresponding recess 48 is snug, and a sheet 50 of resilient packing material, such as commonly available "bubble wrap", may be wrapped around framed painting 10 and interposed between the framed painting 10 and the inner frame 30, including between each corner 20 and a corresponding recess 48, to assure a snug fit and to protect against marring of the framed painting 10.

Figure 2:
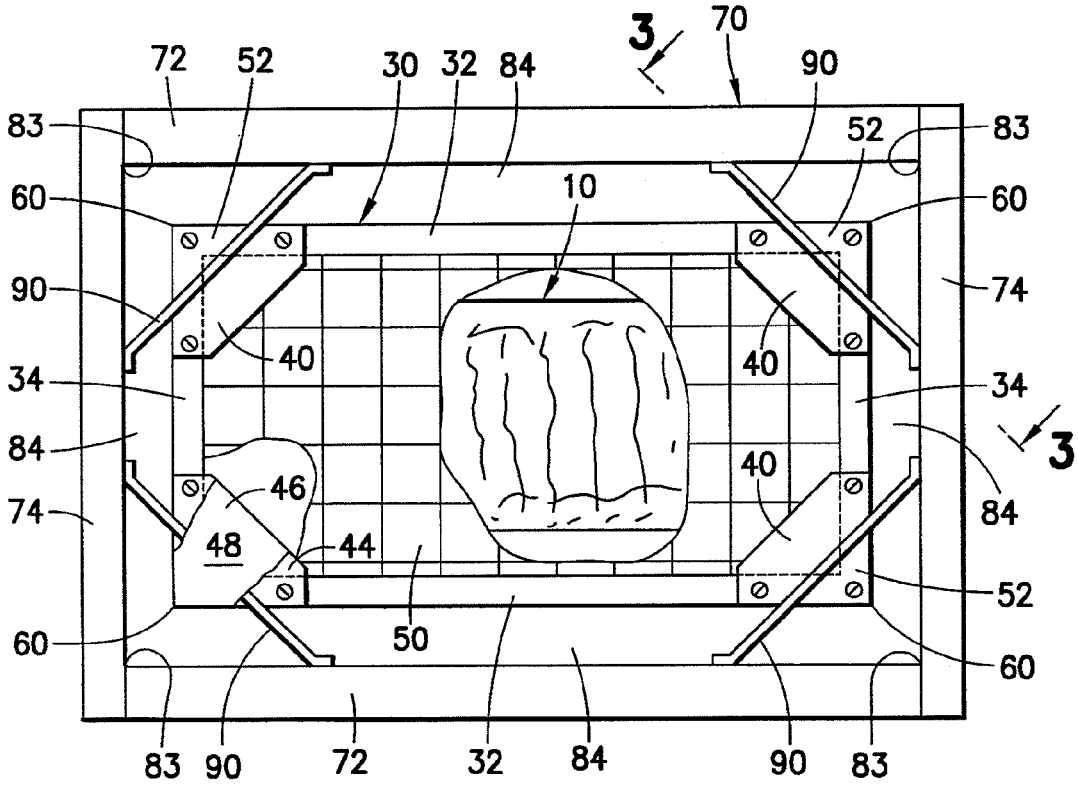
FIG. 2 is a top plan view showing the container during a further stage of the method.

The relative dimensions of the corner connections 40 and the inner frame 30 are such that upon affixing the gussets 44 and 46 to the frame members 32 and 34 to establish the corner connections 40, as seen in FIG. 2, the corner connections 40 are spaced apart from one another along the perimeter 16 of the framed painting 10 to connect the inner frame 30 to the framed painting 10 only at spaced apart locations 52 along the perimeter 16 of the framed painting 10 and thereby establish inner corners 60 corresponding to corners 20 of the wrapped framed painting 10. In the preferred construction, the gussets 44 and 46 of each corner connection 40 are affixed to the frame members 32 and 34 with threaded fasteners 62. The frame members 32 and 34 are secured together at corners 20 by the affixation of gussets 44 and 46 to the frame members 32 and 34. In this manner, framed painting 10 is encased and secured readily within the inner frame 30 utilizing relatively inexpensive materials and commonly available tools and fasteners, requiring only moderate skills. The thus encased framed painting 10 has an overall altitudinal height 66, as seen in FIG. 3.

Figure 4:
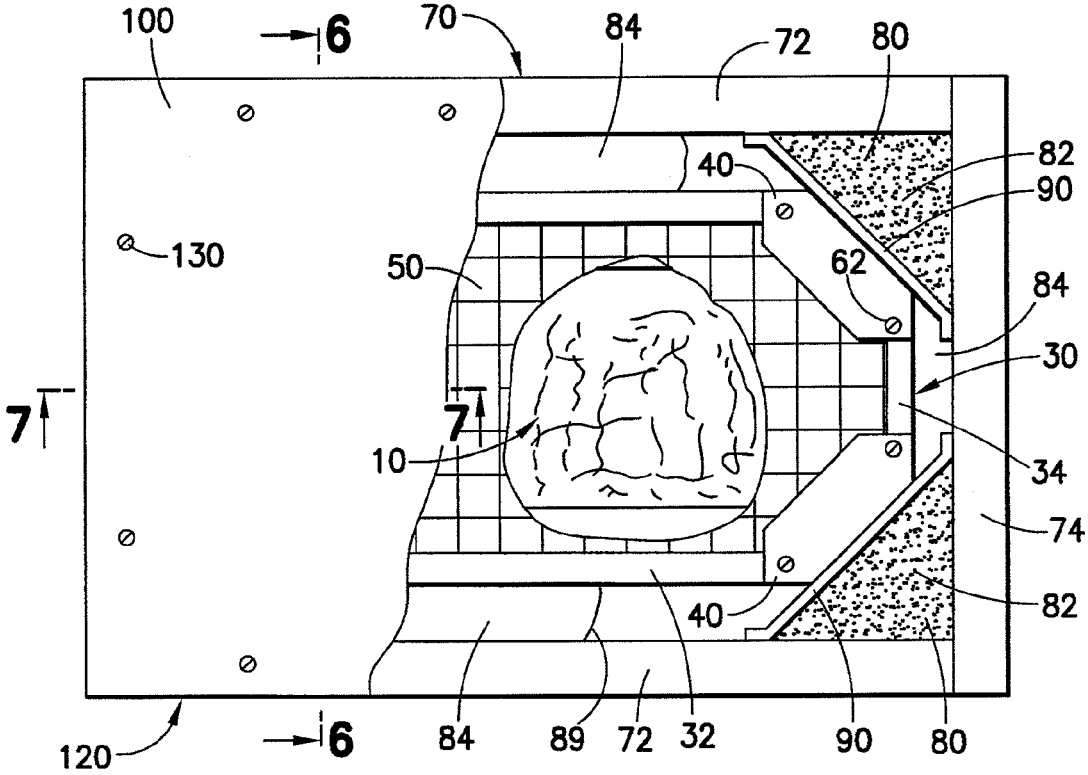
FIG. 4 is a top plan view showing a valued article fully contained in accordance with the present invention.

Once the inner frame 30 is assembled and secured about the framed painting 10, an outer frame 70 is extended perimetrically around the inner frame 30, and the inner frame 30, with the framed painting 10, is suspended within the outer frame 70. Outer frame 70 includes longitudinal frame members 72 and lateral frame members 74 assembled into a rectangular outer frame 70 dimensioned and configured for being spaced outwardly away from the inner frame 30 upon placement of the outer frame 70 perimetrically around inner frame 30. As seen in FIG. 4, suspenders in the form of corner suspenders 80 then suspend the inner frame 30 from the outer frame 70 only at four perimetrically spaced apart locations 82, shown at inner corners 60 corresponding to the four corners 20, the corner suspenders 80 being dimensioned and configured for spacing the outer frame 70 outwardly from the inner frame 30 to establish outer corners 83 spaced from corresponding inner corners 60 and to establish open gaps 84 along perimetric distances between adjacent suspenders 80. Additionally, the outer frame 70 is provided with an altitudinal height 86 between front and back edges 87 and 88, respectively, altitudinal height 86 being greater than the corresponding altitudinal height 66 of the encased framed painting 10, for purposes to be set forth below. The outer frame 70 is constructed readily and economically from an inexpensive material, such as crate wood, and has a simple rectangular configuration. The suspenders 80 are constructed of a shock-absorbent material for deterring the transmission of shocks from the outer frame 70 to the inner frame 30. A preferred material for suspenders 80 is a polyurethane foam available commercially from Alta Packaging Inc. under the name INSTAPAK.

Figure 3:
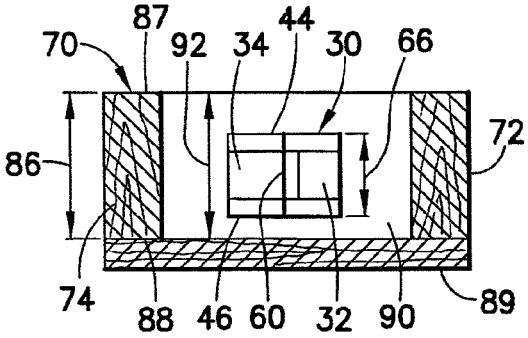
FIG. 3 is a cross-sectional view taken along line 3-3 of FIG. 2.

In a preferred method of suspending the inner frame 30 from the outer frame 70, a back cover 89 is affixed to the back edges 88 of the outer frame 70 to close the back of the container, spacers 90 are placed at each corner of the inner frame 30, and the assembled inner frame 30 and framed painting 10, with spacers 90 in place, is nested within frame 70, as seen in FIGS. 2 and 3. The spacers 90 extend across each corner of the inner frame 30 and a corresponding corner of the outer frame 70 and locate the inner frame 30 within the outer frame 70, appropriately spaced from the outer frame 70. In addition, the spacers 90 have an altitudinal height 92 corresponding to the height 86 between the front and back edges 87 and 88 of the outer frame 70 and are fitted over the inner corners 60 of the encased framed painting 10 to space the inner frame 30, and the encased framed painting 10, from each of the front and back edges 87 and 88 of the outer frame.

Figure 5:
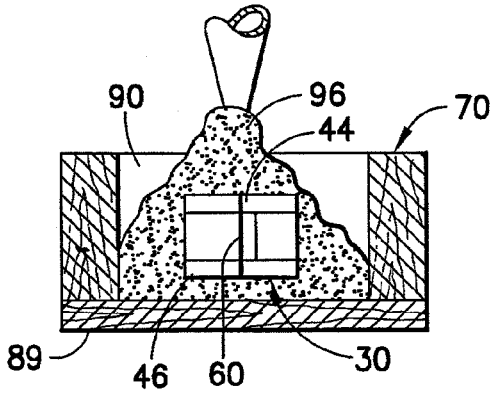
FIG. 5 is a cross-sectional view similar to FIG. 3 and showing a still further stage of the method.

Polyurethane foam 96 in fluid form then is injected into each corner, between the inner frame 30 and the outer frame 70, as seen in FIG. 5, and, with the spacers 90 serving as dams to confine the fluid foam 96 to the corners, the foam is allowed to set. Once the foam is set, the inner frame 30 is suspended from the outer frame by fully formed polyurethane suspenders 80 at each corner 60 and 83 of the assembled inner and outer frames 30 and 70, respectively, which suspenders 80 isolate the inner frame 30, and consequently the encased framed painting 10, from shocks which otherwise could be transmitted from the outer frame 70 to the inner frame 30. It is noted that the spacers 90 are constructed of a relatively weak material, such as paper or cardboard, which can serve temporarily as a spacer and a dam, allowing the suspenders 80 to be formed in situ, as described above, but which is incapable of transmitting shocks from the outer frame 70 to the inner frame 30.

Figure 6:
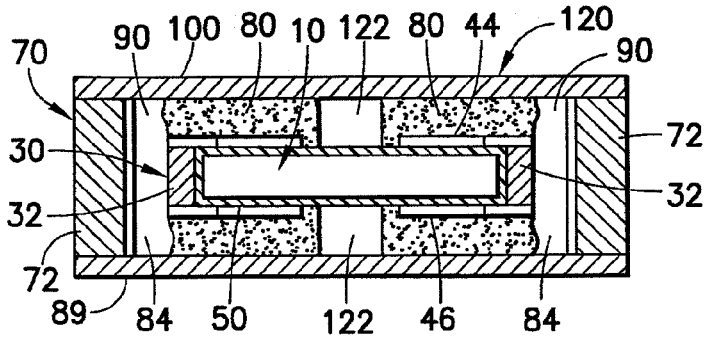
FIG. 6 is a cross-sectional view taken along line 6-6 of FIG. 4.
Figure 7:
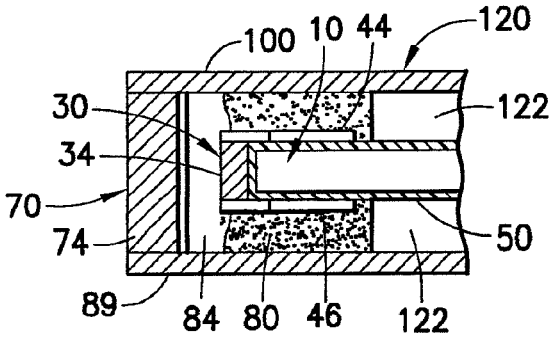
FIG. 7 is a cross-sectional view taken along line 7-7 of FIG. 4.

Once the inner frame 30 is suspended from the outer frame 70, as seen in FIGS. 4, 6 and 7, a front cover 100 is secured to the front edge 87 of the outer frame 70 to fully contain the framed painting 10 within a completed container 120. When thus fully contained, framed painting 10 is suspended only at limited locations, that is, at corners 20, and is isolated from shocks by suspenders 80. In addition, the open gaps 84 established between the outer frame 70 and the inner frame 30, and further open gaps 122 established between the front cover 100 and the framed painting 10, and between the back cover 89 and the framed painting 10, as seen in FIGS. 6 and 7, deter the transmission of impacts from outside the container 120 to the framed painting 10. The open gaps 84 and 122, contain no material which could transmit impacts, and serve as simple barriers against the transmission of impacts to the framed painting 10. Moreover, by suspending the contained article at limited locations along the perimeter of the article, as illustrated by the suspension of framed painting 10 at corners 20, container 120 readily is tailored to articles having a wide variety of shapes in a wide range of sizes. In the preferred construction, the front and back covers 100 and 89 are secured to the outer frame 70 with threaded fasteners 130.

When it is desired to remove the framed painting 10 from the container 120, threaded fasteners 130 are withdrawn readily to enable removal of at least one of the front and back covers 100 and 89. Portions of the suspenders 80 readily are cut away from the corner connections 40 to expose threaded fasteners 62 which then are removed with ease to allow removal of a gusset 44 or 46 from each corner connection 40. Once a gusset 44 or 46 is removed from each corner connection 40, the framed painting 10 may be lifted from the inner frame 30 fully intact and unharmed. In an alternate construction, since only one of the gussets 44 or 46 need be removed at each corner 20 in order to release framed painting 10 from inner frame 30, the removable gusset may be secured within inner frame 30 with selectively removable threaded fasteners 62, while the other gusset may be secured within inner frame 30 with an alternate affixation arrangement, such as with an adhesive.

It will be seen that the present invention attains all of the objects and advantages summarized above, namely: Attains a high level of protection against damage during transportation an storage of a valued article with a relatively economical construction and method; provides a construction and method for isolation of a packed article from deleterious shocks and impacts during transportation and storage of the article, and does so with increased ease, economy and simplicity; enables the accomplishment of effective protective packing of valued articles for transport and storage utilizing readily available materials and requiring only moderate skills, and capable of being completed without the necessity for specialized facilities; maximizes effective protective packing tailored specifically to the particular dimensions and configuration of a valued article, such as artwork, an antiquity or a collectible, with minimal expense, in terms of requirements in materials, labor and facilities; attains consistently reliable results in the protective packing of valued articles with minimal expenditure of time and materials; enables increased ease of unpacking valued articles protected against damage during transport and storage, with minimal risk of damage to the article during unpacking, and with reduced waste of packing materials; provides exemplary performance with increased economy in the effective containment of valued articles over a wide range of shapes and sizes protected against damage during transport and storage.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. A container for containing a valued article protected against impact and shock during transportation and storage, the article having a front face, a back face, and a perimeter bordering the front face and the back face of the article and extending perimetrically around the article, the container comprising:

an inner frame dimensioned and configured for extending around the perimeter of the article;

connections for connecting the inner frame to the article at spaced apart locations along the perimeter of the article;

an outer frame for extending perimetrically around the inner frame, the outer frame being dimensioned and configured for being spaced outwardly away from the inner frame upon placement of the outer frame perimetrically around the inner frame;

suspenders for suspending the inner frame from the outer frame at perimetrically spaced apart locations, the suspenders being dimensioned and configured for spacing the outer frame from the inner frame to establish first open gaps along perimetric distances between adjacent suspenders upon suspending the inner frame from the outer frame;

the suspenders being constructed of a shock-absorbent material for deterring the transmission of shocks from the outer frame to the inner frame; and front and back cover members for securement to the outer frame, the front and back covers being dimensioned and configured to extend over the front face and the back face, respectively, of the article;

the outer frame being further dimensioned and configured for spacing the front and back cover members respectively forward and back from the article and from the inner frame to establish second open gaps between the article and the front and back covers and between the inner frame and the front and back covers upon securement of the front and back covers to the outer frame;

the first and second open gaps deterring the transmission of impacts from outside the container to the article.

2. The container of claim 1 wherein the perimeter of the article includes a plurality of perimetrically spaced-apart corners, the connections are located at the corners, and the suspenders are located at the connections.

3. The container of claim 2 wherein the suspenders are constructed of a foamed synthetic polymeric material.

4. The container of claim 3 wherein the foamed synthetic polymeric material is a polyurethane foam.

5. The container of claim 3 wherein the suspenders are formed in situ between the connections and the outer frame.

6. The container of claim 5 wherein:

the inner frame includes inner corners corresponding to corners of the perimeter of the article;

the outer frame includes outer corners corresponding to the inner corners and spaced a distance from respective corresponding inner corners; and the suspenders span the distance between the corresponding spaced apart inner and outer corners.

7. The container of claim 1 wherein the suspenders are constructed of a foamed synthetic polymeric material.

8. The container of claim 7 wherein the foamed synthetic polymeric material is a polyurethane foam.

9. The container of claim 7 wherein the suspenders are formed in situ between the connections and the outer frame.

10. A method for protecting an article against impact and shock during transportation and storage, the article having a front face, a back face, and a perimeter bordering the front face and the back face of the article and extending perimetrically around the article, the method comprising:

extending an inner frame around the perimeter of the article;

connecting the inner frame to the article at connections placed only at spaced apart locations along the perimeter of the article;

extending an outer frame perimetrically around the inner frame, and dimensioning and configuring the outer frame so as to space the outer frame outwardly away from the inner frame upon placement of the outer frame perimetrically around the inner frame;

suspending the inner frame from the outer frame at suspenders placed at perimetrically spaced apart locations, and dimensioning and configuring the suspenders so as to space the outer frame from the inner frame and establish first open gaps along perimetric distances between adjacent suspenders upon suspending the inner frame from the outer frame;

constructing the suspenders of a shock-absorbent material so as to deter the transmission of shocks from the outer frame to the inner frame;

securing front and back cover members to the outer frame, and dimensioning and configuring the front and back covers so as to extend the front and back covers over the front face and the back face, respectively, of the article; and further dimensioning and configuring the outer frame so as to space the front and back cover members respectively forward and back from the article and from the inner frame and establish second open gaps between the article and the front and back covers and between the inner frame and the front and back covers upon securement of the front and back covers to the outer frame;

whereby the first and second open gaps deter the transmission of impacts from outside the container to the article.

11. The method of claim 10 wherein the perimeter of the article includes a plurality of perimetrically spaced-apart corners, the method including locating the connections at the corners, and locating the suspenders at the connections.

12. The method of claim 11 including constructing the suspenders of a foamed synthetic polymeric material.

13. The method of claim 11 including constructing the suspenders of a polyurethane foam.

14. The method of claim 11 including constructing the suspenders of a foamed synthetic polymeric material formed in situ between the connections and the outer frame.

15. The method of claim 14 including:

dimensioning and configuring the inner frame to include inner corners corresponding to corners of the perimeter of the article;

dimensioning and configuring the outer frame to include outer corners corresponding to the inner corners and spaced a distance from respective corresponding inner corners; and forming the suspenders to span the distance between the corresponding spaced apart inner and outer corners.

16. The method of claim 10 including constructing the suspenders of a foamed synthetic polymeric material.

17. The method of claim 10 including constructing the suspenders of a polyurethane foam.

18. The method of claim 10 including constructing the suspenders of a foamed synthetic polymeric material formed in situ between the connections and the outer frame.

* * * * *